United States Patent [19]

Salin et al.

[11] Patent Number: 4,675,647

[45] Date of Patent: Jun. 23, 1987

[54] SYSTEM FOR DETERMINING A QUEUE SEQUENCE FOR SERVING CUSTOMERS AT A PLURALITY OF SERVICE POINTS

[76] Inventors: Rune Salin, Fyrmästarvägen 1; Per Martin Pettersson, Ljungliden 20, both of 439 00 Onsala, Sweden

[21] Appl. No.: 476,876

[22] PCT Filed: Jul. 14, 1982

[86] PCT No.: PCT/SE82/00244

§ 371 Date: Mar. 18, 1983

§ 102(e) Date: Mar. 18, 1983

[87] PCT Pub. No.: WO83/00399

PCT Pub. Date: Feb. 3, 1983

[30] Foreign Application Priority Data

Jul. 20, 1981 [SE] Sweden ..... 8104445

[51] Int. Cl.[4] ..... G08B 7/00; G07G 5/00

[52] U.S. Cl. ..... 340/286 R; 377/1

[58] Field of Search ..... 340/286 R, 51; 225/10, 225/11; 83/367; 364/709, 710; 235/382, 375; 377/1

[56] References Cited

U.S. PATENT DOCUMENTS

| | | | |
|---|---|---|---|
| 3,803,578 | 4/1974 | La Vanway | 340/286 |
| 3,893,094 | 7/1975 | Thorson et al. | 340/286 X |
| 4,398,257 | 8/1983 | Paganini et al. | 340/286 X |

OTHER PUBLICATIONS

"Ny lokalkontorsidé *Mahmo*", *by Erling Borgshammar, (Swedish newspaper article).*

"Bela Elektroniska Kösystem", (Swedish brochure).

*Primary Examiner*—John W. Caldwell, Sr.

*Assistant Examiner*—Tyrone Queen

[57] ABSTRACT

A system for serving customers in a specific queue sequence at a plurality of service points in a bank or post office, for example, makes it possible for customers to select a specific service point, at which service is desired, while maintaining a turn-number system which is common to all the service points. If a customer indicates, when being allocated a turn-number, that he selects a desired service point the system registers the indication in a memory unit. The customers are served in numerical sequence at the service points which are free, and any selective customers are served at their desired service point, preferably when the correct number comes up, and as the selected service point becomes free.

10 Claims, 7 Drawing Figures

SYSTEM FOR DETERMINING A QUEUE SEQUENCE FOR SERVING CUSTOMERS AT A PLURALITY OF SERVICE POINTS

BACKGROUND OF THE INVENTION

The present invention relates to a process for serving customers in a specific queue sequence at a plurality of service points, etc., such as bank or post office service points, together with a system for carrying out the process.

SUMMARY OF THE INVENTION

The main object of the present invention is to provide a process of the above-mentioned kind which makes it possible for customers to choose a specific service point, etc. at which they desire to be served, for example, in a bank or post office, despite the existence of a numerical sequence system of taking turns which is common to a plurality of service points. Another object is to provide a system which is suitable for carrying out such a process.

The object is achieved with a process according to the present invention which is primarily characterised in that, if a customer indicates the selection of a desired service point, etc. when being allocated a turn-number, etc., this indication is registered in a memory unit, and that the customers are served in numerical sequence at the service points, etc. which are free, any customers who have made a selection being served at the desired service point, preferably when the correct number comes up, and as the desired service point becomes free.

A system for carrying out the process is characterised in that it comprises a turn-number device with memory facilities and with the possibility for selection of a service point, an information unit connected to the said device and designed to be able to indicate which turn-number is to be served next and at which service point service is to be given, and that at least one terminal is connected to said device, for transmitting information to the device from the respective service points.

BRIEF DESCRIPTION OF THE DRAWING

In the following an embodiment example of the subject of the invention is described with reference to the accompanying drawings, in which.

DESCRIPTION OF THE PREFERRED EMBODIMENT

Figure 5:
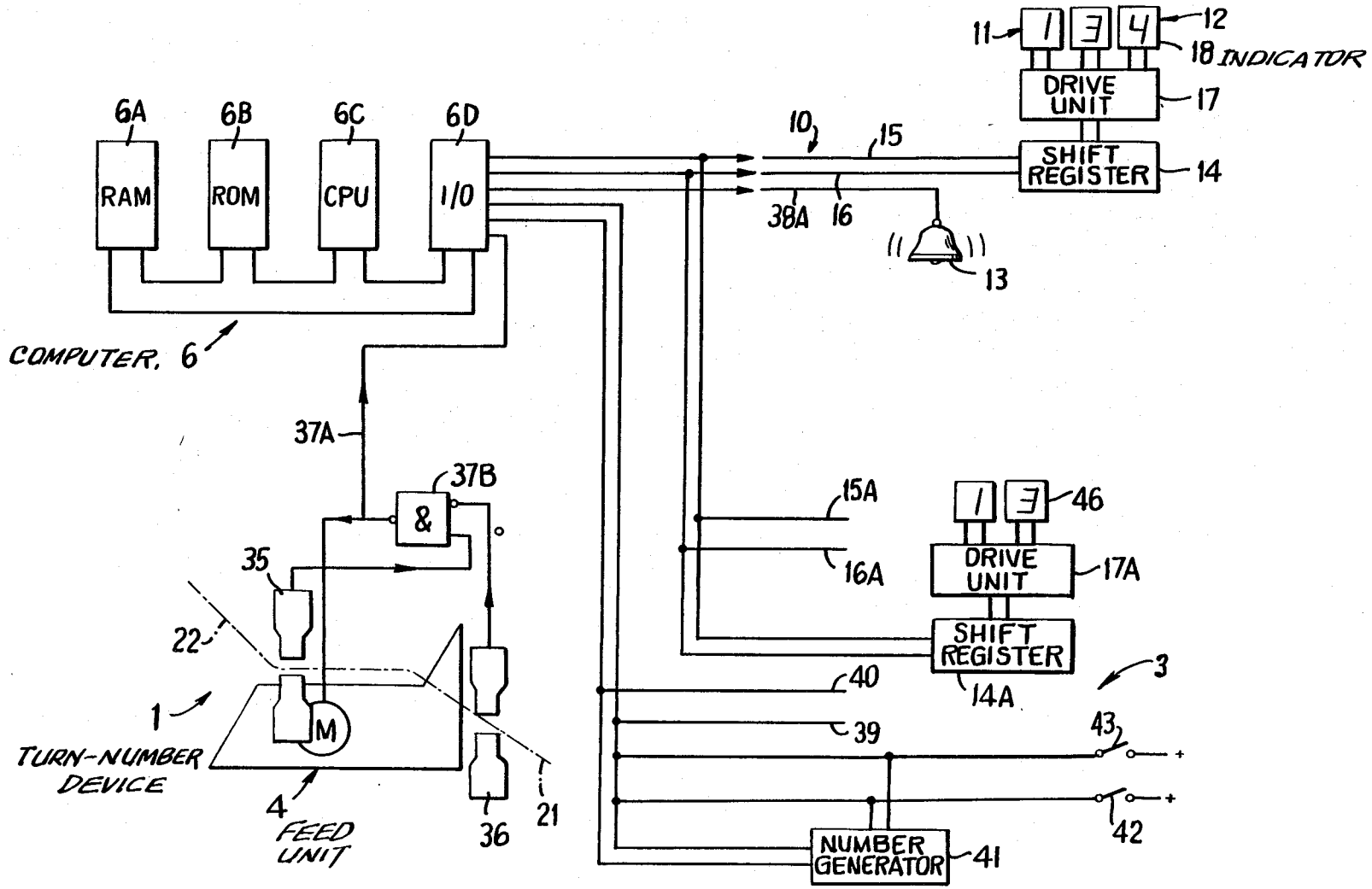
FIG. 5 shows schematically the connection of the electronics comprised in the system.

The system according to the present invention comprises basically three different units, namely, a turn-number device 1, an information unit 2, and a plurality of terminals 3 which are connected to the turn-number device 1. The linking of the units 1, 2 and 3 to each other is shown schematically in FIG. 1, which the connection of the electronics is shown in FIG. 5.

The turn-number device 1 which is designed to be installed in a bank or post office or in any other location where the system is to be used and where the customers can see all the service points, comprises a selection unit 5 which enables the customer to select a desired service point, etc., at which he desires to be served, as well as a turn-number allocating unit 4. A computer 6 which enables the said selection to be put into effect is also expediently comprised in the said device 1.

The system which is preferably designed to be operated from the electrical mains via a connection 7, possibly with a current supply provided when the mains supply is interrupted, enables the customer to indicate the selection himself or herself via the said selection unit 5, preferably before he/she receives a turn-number, by manual operation of the selection controls in the form of push-buttons 8, for example, which indicate by means of a signal light, for example, if the service point to which the push-button 8 relates, for example, according to the numeral 9 on and/or adjacent to it, is free.

The information unit 2, which is connected to the computer 6 via a lead 10, for example, consists preferably of a display panel which is known per se and which is equipped with a digital display 11 for indicating which turn-number is to be served next and also a display arrangement 12 for indicating at which service point, etc. the customer is to be served. An audible device in the form of a bell 13, for example, may also be connected, for indicating that a new turn-number 11 is coming up. The said audible device 13 may also have other functions such as, for example, indicating when there is a fault in the system, as will be described later.

The construction of the information unit 2, which can naturally also be other than as shown, for example, with the possibility of audible information of the turn-numbers and service point numbers, will now be described in more detail with regard to its electronics, with special reference to FIG. 5 on the drawings. A shift register 14 with 16 bits is connected to the computer 6 via separate data transmission 15 and clock transmission 16 comprised in the lead 10. A so-called BCD seven-segment drive unit 17 is connected in between the shift register 14 and three or four indicators 18 for driving the indicators 18, which indicators 18 are constructed as seven-segment indicators.

Figure 1:
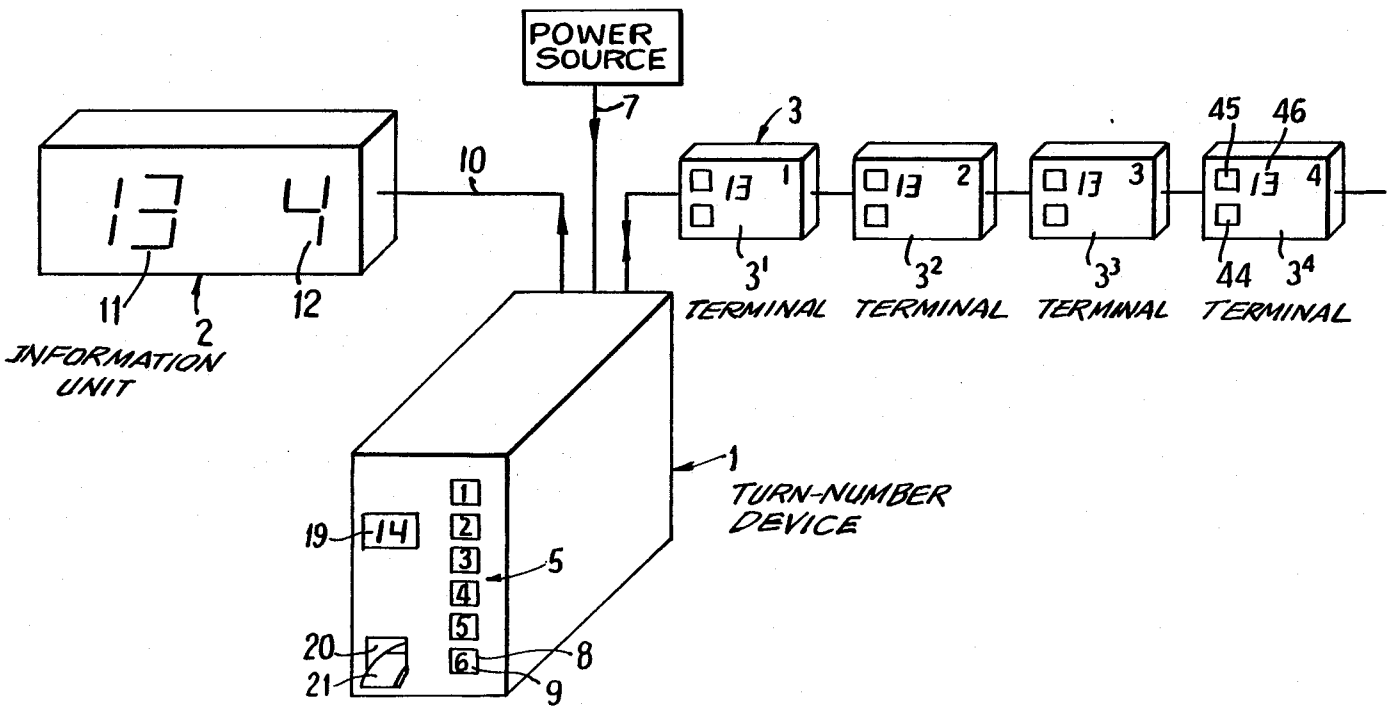
FIG. 1 shows the system schematically.

In addition to the turn-number feed unit 4, the turn-number device 1 which is shown in FIG. 1 and elsewhere, comprises a display panel 19 or the like on which the turn-number which is next in turn to be supplied by the device 1 is indicated, for example, in the form of an illuminated number.

Figure 2:
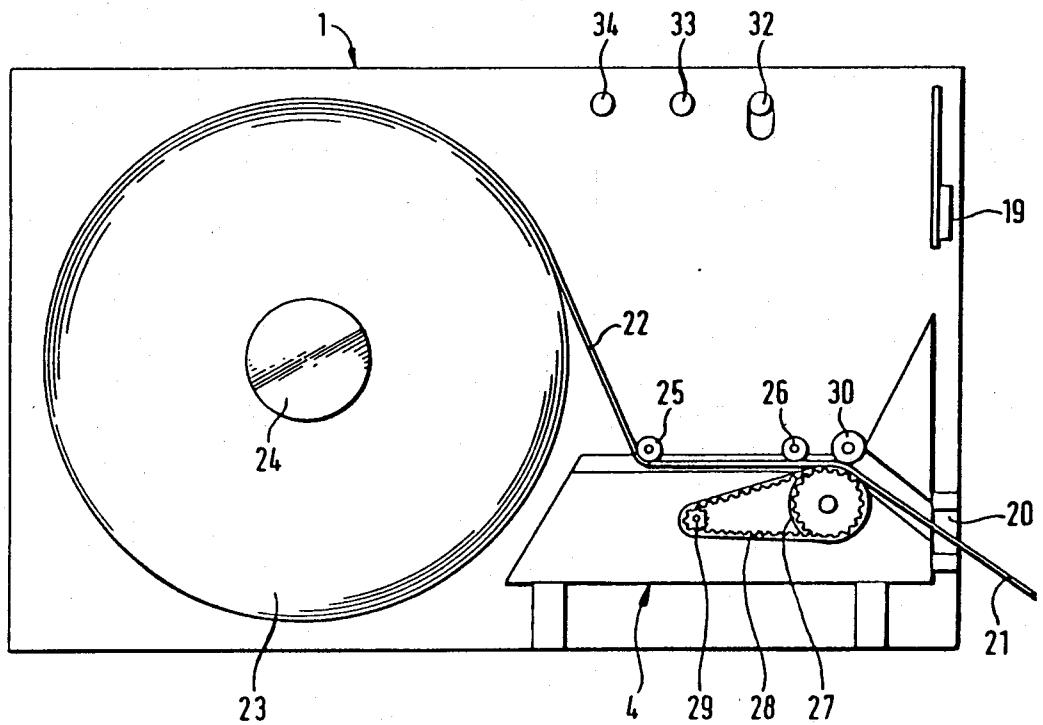
FIG. 2 shows a turn-number device comprised in the arrangement, which is designed to feed out number slips in the form of a tape from a roll.

The device 1 also has an aperture 20 through which turn-number slips 21 are fed out automatically. This automatic feed is made possible due to the feed unit 4 and monitoring and actuating devices. The turn-number slips 21, 21' and so on are joined together as shown in FIG. 2 to form a tape 22 and are wound up in the form of a roll 23 which is supported on an axle 24 and is looped around and controlled by separate control rods 25 and 26 respectively, located at a mutual distance from each other along the feed-out from the roll 23. The tape 22 can be driven by means of a rubber roller 27 which transmits the drive movement from a motor 29, via a toothed belt 28, for example. A device in the form of a pressure roller 30 which is located counter to the drive roller 27 is mounted so that it can be pivoted in the direction from the tape 22 and the drive roller 27 in the direction of the arrow by a linked-arm device 31 which consists of four arm links 31A–31D. By rotating the link 31A in the clockwise direction, as shown on the drawing, the said pressure roller 30 is lifted from the tape 22, allowing a new ticket tape 22 to be inserted in the unit 4.

A switch 32 is connected to the drive arrangement 27–28 for the tape 22 so that, for example, when the switch is actuated in the direction towards the right or left respectively, the ticket tape 22 is continuously fed forwards or backwards, and when the switch 32 is set in a middle position one turn-number slip 21 is fed out when a preceding slip is obtained by a customer.

On the other hand, switches 33 and 34 respectively are connected to a display panel 19 of the device 1 in such a way that when one of the switches 33 is actuated the supply of numbers thereon increases by one number for each actuation, while actuation of the switch 34 feeds through more numbers at a time, for example, ten at a time. The said switching is necessary after a ticket roll 23 has been changed, so that the number on the display panel 19 will correspond to the turn-number which is due to be supplied by the device 1.

Figure 3:
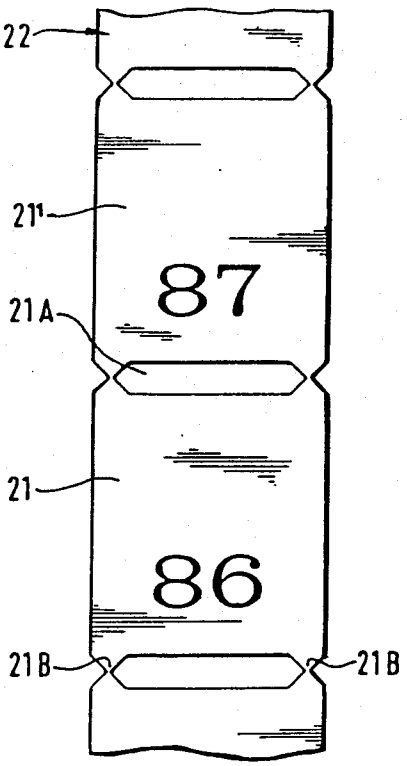
FIG. 3 shows a pulled-out length of the said number slip tape which is made into a roll.

FIG. 3 shows a preferred form of a ticket tape 22 which is suitable for use in a device 1 constructed according to the invention. The number slips 21, 21' located in sequence one after the other have a gap formed as a perforation 21A, preferably in the center of the tape 22, the function of which will be explained later. At the edges of the tape 22 weakened areas 21B from the perforations 21A, for example, are provided with the aim of facilitating separation of the tickets 21, 21' from each other when they are fed out of the device 1.

Figure 4:
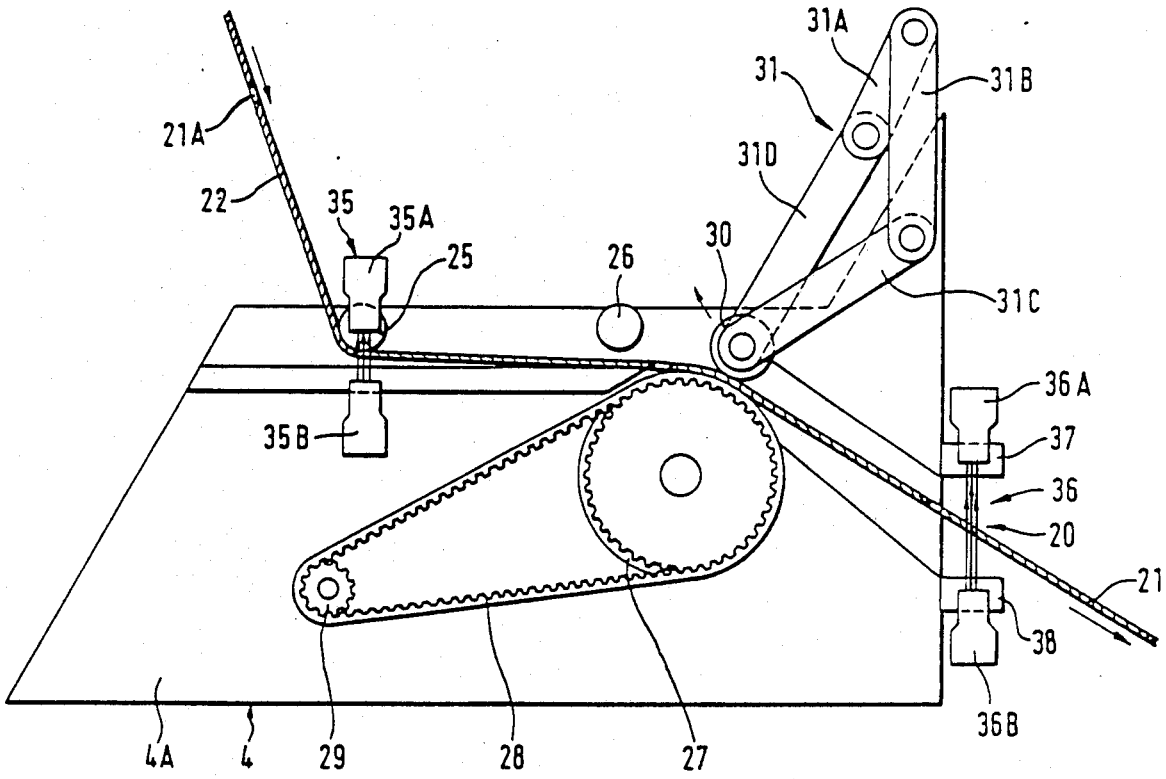
FIG. 4 shows schematically a number slip feed-out unit appertaining to the device shown in FIG. 2.

As can be seen from FIG. 4, two photocell units 35 and 36 respectively, located at a mutual distance from each other along the tape 22, are mounted on either side of the path along which the ticket tape 22 is designed to pass through the device 1. One part 35A of the rear photocell unit 35 is supported by the control rod 25, and its other part 35B is supported by the member 4A of the unit 4, while the two parts 36A and 36B respectively of the front photocell unit 36 are supported by holders 37 and 38 respectively on either side of the ticket feed-out opening 20. The two photocell units 35, 36 are intended to monitor the position of the ticket tape 22 and transmit information to the drive arrangement 27–29 for the tape 22. The rear unit 35 is arranged so that it can shine through the perforation 21A between the tickets 21, 21' when the tape 22 is fed out into the correct position, while the front unit is designed so that it is not able to shine through the ticket tape 22 in the said position. The drive unit 4 and the said photocell units 35, 36 which are connected to the computer unit 6 via and AND gate 37B and a connection 37A, are designed to give the alarm, for example, by signalling, when there is a long delay between indication of the perforation 21A on the ticket tape 22 while it is being fed through. Each indication is also transmitted to the display panel 19 for giving out a new number, i.e. the same number as is on the new ticket 21 which is about to be separated from the ticket tape 22.

The computer 6, which is shown schematically in FIG. 5, preferably comprises a read-write memory 6A, a read only memory 6B, a central processor unit 6C and an input-output unit 6D, which can be connected in the way which is shown on the drawing. The bell 13 is connected to the said computer 6 via a bell connection 38A.

A terminal $3^1$, $3^2$, $3^3$, $3^4$ etc. is intended to be installed so that it is easily accessible to the cashiers at the respective service points, and is connected to the computer 6 via leads 15A and 16A respectively, and 39, 40, as shown in FIG. 5. Such a terminal 3 may consist of a terminal number generator 41 with two switches 42 and 43 respectively which are connected to push-buttons 44, 45 or similar controls, which signal to the device 1 to feed out a new turn-number or that the service point is closed. The number-indicating window 46 on the terminal 3 is of a similar type to the indicating arrangement 11 on the information unit 2, and is constructed in a similar way, but without the service point indication and the bell.

Figure 6:
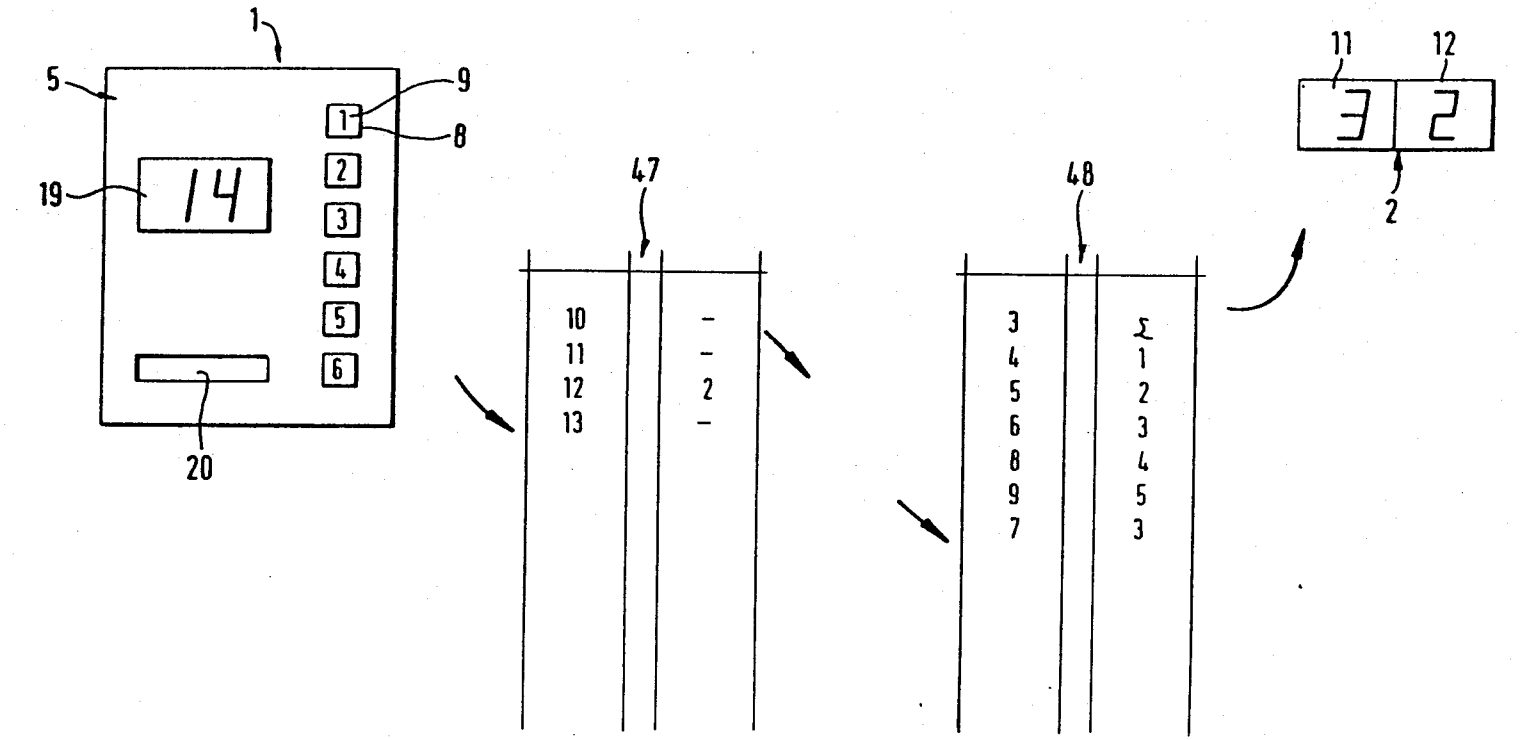
FIG. 6 shows schematically the movement sequence of the turn-numbers in the computer program appertaining to the system.

FIG. 6 shows schematically the sequence of events in the computer 6 when the turn-numbers move on in the computer program. The left-hand column 47 relates to turn-numbers which have been fed in with any service point registrations, for example, turn-numbers 10, 11 and 13 with no service point selection, but number 12 with indication of the selection of service point 2. The right-hand column 48 relates to the feeding out of the turn-numbers with reference to the service points. For example, turn-number 3 is referred to service point 2, turn-number 4 is referred to service point 1, and so on. When a ticket 21 is taken out of the device 1 the said turn-number and any indication of service point are transmitted to the bottom of the left-hand column 47. The turn-number which is at the top of the said column, for example 10, is next in turn to be served when any service point whatsoever becomes free, while, for example, turn-number 12 with service point selection 2 is next in turn to be served when turn-number 12 reaches the right-hand column 48 and when service point 2 is free. If service point 2 is engaged at that time the customer is passed over and the next turn-number is fed out, for example, service point 13-4, since this customer has not indicated selection of any particular service point. Only when the service point 2 is free is the number 12-2 fed out onto the display panels 11 and 12. It is expedient if the turn-numbers are fed out to the information unit 2 with at least a 5 sec interval between them so that customers are able to absorb the turn-number and the service point information. When the column 47 is empty the terminal 3 is designed to prevent new ticket numbers being fed out.

Figure 7:
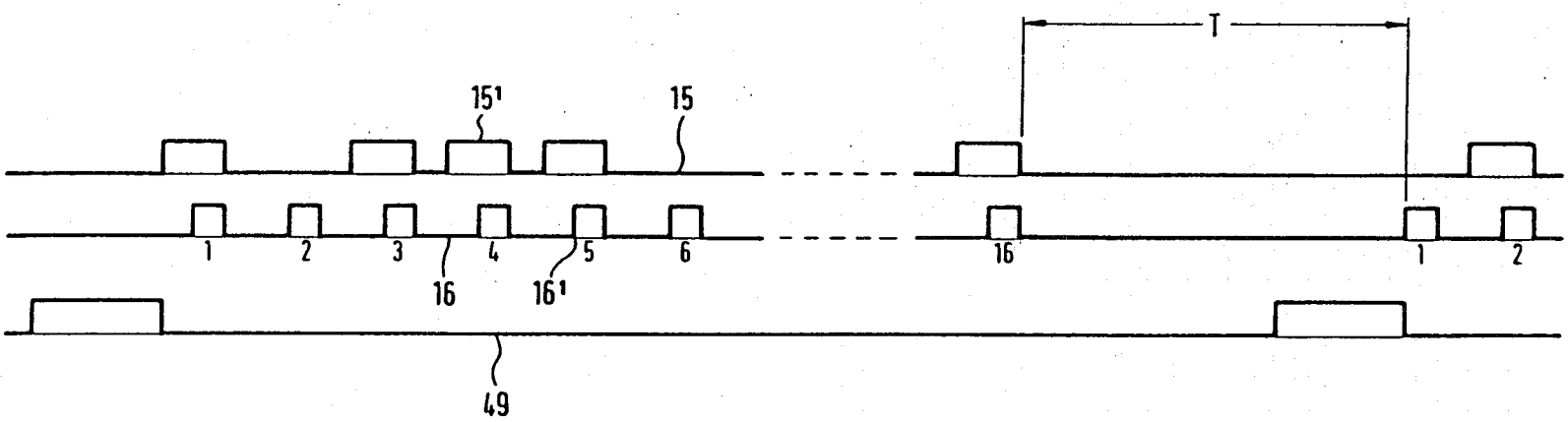
FIG. 7 shows schematically how information is transmitted in the system.

The transfer of information between the computer 6 and the information unit 2 and the terminals 3 is effected in the following way (reference is made here to FIG. 7): A transmission consists of, for example, 16 clock impulses 16 and a dead period T. Data information 15 which arrives first is clocked into the shift register 14 by the upwards moving part 16' of the clock signal 16. This is repeated 16 times, after which the dead period T is detected by a circuit 49 and produces strobe pulses which transmit the information to the drive units 17 for the seven-segment indicators 18.

The functioning of the system is as follows: When receiving a turn-number slip 21 the customer is requested by a notice on the device 1, for example, to indicate if a special service point is desired, by pressing the push-button 8, etc., for example, which corresponds to the designation 9 on the desired service point. The said push-button 8 is designed to flash, for example, for around 10 seconds, during which time the turn-number slip 21 must be taken out of the device for the indication of the service point to be registered. As stated, the said push-buttons 8 are designed to light up or to indicate in some other way if the relevant service point is free. The indication and the removal of a turn-number slip is recorded in the computer 6, whereupon a new ticket 21' with the next turn-number is fed into the position for removal from the device in the way described above, by means of the feed unit 4, and the said turn-number is indicated on the panel 19 of the device 1. The information from the cashier on the terminal 3 at the respective service points is transmitted to the device 1 and the computer 6 so that the turn-number which is next in turn to be fed out of the column 47 in FIG. 6, the top one, is indicated on the panels 11 and 12 respectively of the information unit 2. However, this does not occur if a particular service point has been indicated by the customer and the said indicated service point does not correspond with the free service point. If this is the case, the said customer is automatically held waiting until his indicated service point is free, and a new turn-number is fed out, and so on. If the service point at which the customer indicated he wishes to be served is closed, then if the terminal 3 does not indicate that the said service point has been selected the said customer is transferred to any other service point whatsoever when his allocated turn-number comes up. Each time a new number is fed out a time, such as 10 minutes, for example, can be set for the terminal 3 involved. The said time is reduced down towards nil when there are customers waiting to be served. When no more customers are waiting to be served, which is automatically detected through the left-hand column 47 in the computer 6, the count-down is halted and when the time has elapsed the terminal 3 and the service point are closed automatically.

The system can also be designed to indicate if there is too long a queue at every open terminal and service point, by monitoring automatically the number in the column 47 and dividing by a certain number and indicating if the queue for service points is too long, by ringing a bell a certain number of times, for example, and indicating that further service points should be opened.

When the column 47 with the turn-numbers has been empty for a certain predetermined period of time, such as 5 minutes, for example, the panels 11, 12 of the information unit 2 with the indication at the terminals can be taken out automatically, by switching them off, for example, and thereafter automatically switched on and illuminated again when a turn-number is once more removed from the device 1, or switched on for a shorter period, of around 10 seconds, for example, when a signal is generated from a service point terminal 3.

Preferably, it will be indicated, for example, by a flashing lamp clearly visible to the customer and located at the respective service points, which service point the customer is being referred to when the right turn-number is fed out.

The invention is not limited to the embodiment which is described above and shown on the drawings purely as an example, but its details can be modified within the frame of the following claims. The system is naturally not restricted to turn-numbers in the form of tickets, but other forms are of course also possible. Other applications than service points in post offices and banks are naturally also suitable for the system.

It is of course possible to connect a camera to the system to make it easier to catch any robbers, against whom the present system provides an important deterrent, since the end of the queue is preferably located some way away from the service points. It is also possible to make a button, etc. available on the device, for customers with urgent requirements to use, for example, at ticket sales offices and the like where it is important that a certain specific time should not be exceeded.

We claim:

1. A system for determining a queue sequence for serving customers at a plurality of service points, comprising:

a turn-number device having a selection unit enabling a customer to select a desired service point among said plurality of service points;

a turn-number allocating unit allocating a turn-number to every customer desiring to be served;

a plurality of terminals located at corresponding ones of said service points, each of said terminals providing a signal identifying a particular service point which is free for serving a customer;

an information unit; and computer means operatively coupled to said turn-number device and said allocating unit and said information unit for memorizing a sequence of allocated turn-numbers with selected desired service points, and for receiving from each of said plurality of terminals a signal identifying a particular service point which is free for serving a customer; said computer means employing the signals of respective ones of said terminals for deciding which particular turn-number is to be served at a particular free service point, and for feeding-out a particular turn-number and identification of the particular free service point to said information unit for indicating a free service point to the customer; the particular turn-number to be served being a next in turn in a memorized sequence of allocated turn-numbers for which no desired service point is selected, or for which a selected desired service point is the particular free service point.

2. A system according to claim 1, wherein said computer means comprises a selection and memory unit providing turn-numbers, and means coupled to said selection and memory unit for feeding out of turn-numbers.

3. A system according to claim 2, wherein said computer means comprises a read-write memory, a read only memory, a central processor unit, and an input-output unit, said central processor unit being operatively connected to said read-write memory and to said read only memory and to said input-output unit.

4. A system according to claim 1, wherein each terminal has manually-operated controls for informing said device at least if the service point is free and if the service point is closed, respectively.

5. A system according to claim 4, wherein said terminals have means showing which turn-number is being served, and said turn-number device having means for showing a number with a value less than the turn-number which is next in turn to be fed out of the device.

6. A system according to claim 1, wherein said turn-number device has manually-operated selection controls designating various service points, said controls indicating if the respective service points are free, and said turn-number device comprising means for indicating which turn-number is next in turn to be fed out of the turn-number device.

7. A system according to claim 1, wherein said turn-number device comprises a number slip-feed unit for feeding out a turn-number slip automatically into a grasping position for a customer when a slip supplied immediately before into said position is removed from the device.

8. A system according to claim 7, wherein the slips are on a number-slip tape, there being a gap between each two adjoining slips, weakened areas in the form of perforations between the slips, and means for monitoring the gap connected to the slip-feed unit.

9. A system according to claim 8, wherein said monitoring means monitors the position of a number slip which has been fed into the grasping position, and transmits information to the slip-feed unit for feeding out a new slip.

10. A system according to claim 7, 8 or 9, further comprising indicators and drive units operatively connected to the indicators for the display of data, and wherein said slip-feed unit operates with a transmission of data in conjunction with a clock transmission, and wherein said slip-feed unit comprises a shift register connected to said drive units and having a plurality of bits associated with the data transmission and the clock transmission, one transmission having clock pulses and a dead period and clocking the data information which occurs first with 16 times repetition, into the shift register from an upwards moving part of the clock signal, said slip-feed unit further comprising a circuit for detecting the dead period for giving out a strobe pulse to said drive units.

* * * * *